US005295796A

United States Patent [19]

Goto et al.

[11] Patent Number: 5,295,796

[45] Date of Patent: Mar. 22, 1994

[54] VARIABLE DISPLACEMENT HYDRAULIC PISTON PUMP WITH TORQUE LIMITER

[75] Inventors: Kunifumi Goto; Shigeru Suzuki; Nobuaki Hoshino; Tatsuyuki Hoshino, all of Kariya, Japan

[73] Assignee: Kabushiki Kaisha Toyoda Jidoshokki Seisakusho, Kariya, Japan

[21] Appl. No.: 966,806

[22] Filed: Oct. 26, 1992

[30] Foreign Application Priority Data

Oct. 31, 1991 [JP] Japan ..... 3-286370

[51] Int. Cl.[5] ..... F04B 1/26

[52] U.S. Cl. ..... 417/222.1; 417/222.2

[58] Field of Search ..... 417/222.1, 222.2, 223, 417/269, 270, 271; 91/473, 475; 384/624, 627; 464/35

[56] References Cited

U.S. PATENT DOCUMENTS

| | | | |
|---|---|---|---|
| Re. 31,711 | 10/1984 | Horiuchi | 417/222.1 |
| 3,153,899 | 10/1964 | Budzich et al. | 417/222.1 |
| 3,381,646 | 5/1983 | Ruseff et al. | 417/222.1 |
| 3,732,041 | 5/1973 | Beal et al. | 417/222.1 |
| 3,818,722 | 6/1974 | Vogel | 464/30 |
| 4,381,647 | 5/1983 | Ruseff | 417/222.1 |
| 4,723,892 | 2/1988 | Cowan | 417/222.1 |
| 5,039,282 | 8/1991 | Terauchi | 417/222.2 |
| 5,095,807 | 3/1992 | Wagenseil | 417/222.1 |

*Primary Examiner*—Richard A. Berisch
*Assistant Examiner*—Alfred Basichas
*Attorney, Agent, or Firm*—Brooks Haidt Haffner & Delahunty

[57] ABSTRACT

A variable displacement hydraulic piston pump having a cylinder block provided with cylinder bores formed therein to receive reciprocatory pistons and capable of rotating together with an axial drive shaft, a swash plate pivotally supported to reciprocate the pistons in the cylinder bores in response to the rotation of the cylinder block thereby discharging pressurized oil, a resilient unit for constantly urging the swash plate to a small inclination-angle position, a hydraulic control cylinder capable of providing the swash plate with a controlled force moving the swash plate toward a large inclination-angle position, an input shaft connected to the drive shaft to transmit a rotary drive power rotating the drive shaft, and a torque limiter arranged between the input and drive shafts so as to be able to disconnect the drive shaft from the input shaft when an abnormal excessive load is applied to the drive shaft thereby protecting internal elements and parts of the pump from damage and breakage.

11 Claims, 3 Drawing Sheets

VARIABLE DISPLACEMENT HYDRAULIC PISTON PUMP WITH TORQUE LIMITER

BACKGROUND OF THE INVENTION

1. Field of the Invention

The present invention relates to a variable displacement hydraulic piston pump used for driving a hydraulic motor that in turn drives a refrigerant compressor incorporated in an air-conditioning system of an automobile, and for hydraulically actuating diverse hydraulic devices mounted on special-purpose vehicles including industrial cars such as dump trucks, garbage trucks, and sanitation vehicles. More particularly, the present invention relates to a variable displacement hydraulic piston pump accommodating a self-guard means capable of preventing the input shaft of the pump from being compulsorily rotated under an over-load to thereby protect the pump against mechanical breakage of the internal elements of the pump.

2. Description of the Related Art

Axial piston pumps (it will be referred to as simply a pump hereinbelow) have been used for various industrial machines and industrial vehicles.

FIG. 3 illustrates a conventional variable displacement hydraulic pump provided with a means for adjustably changing an angle of inclination of a swash plate, which causes a reciprocation of axial pistons. The pump is provided with a hollow housing 1, an end covering 2 closing an end of the housing 1, and a crank chamber 3 defined in the closed housing 1. A drive shaft 4 provided to extend through the crank chamber 3 is rotatably supported by bearings 5 seated in the housing 1 and the end covering 2. A cylinder block 6 is mounted on the drive shaft 4 so as to rotate together with the drive shaft 4 in the crank chamber 3. The cylinder block 6 is provided with a plurality of cylinder bores 7 arranged around and in parallel with the rotating axis of the drive shaft 4, and the respective cylinder bores 7 slidably receive reciprocatory pistons 10 therein, which are engaged with a swash plate 9 via shoes 8.

A valve plate 11 is arranged between the open end of the housing 1 and the end covering 2, and is fixed to the inner face of the end covering 2 to seal the respective open-ended cylinder bores 7. The valve plate 11 is provided with a suction port **12*a* and a discharge port 12*b* formed as an arcuate-shape through-bore, respectively. Namely, the suction and discharge ports 12*a* and 12*b* are circularly elongated so that the respective ports can be in communication with each of the cylinder bores 7 via an opening end 7*a* for a while during the rotation of the cylinder block 6. The suction and discharge ports 12*a* and 12*b* are also in constant communication with suction and discharge bores 13*a* and 13*b*, respectively, formed in the end covering 2**.

When the cylinder block 6 is rotated together with the drive shaft 4, the respective pistons 10 engaged with the swash plate 9 are reciprocated in the respective cylinder bores 7 to alternately cause an increase and a decrease in the closed volume of the respective cylinder bores 7. Thus, when the closed volume of each cylinder bore 7 is increased, the cylinder bore 7 is in communication with the suction port **12*a* so as to pump in the operating oil. When the closed volume of each cylinder bore 7 is decreased, the cylinder bore 7 is in communication with the discharge port 12*b*** so as to discharge the operating oil.

The swash plate 9 is pivotally supported by trunnion shafts (not shown in FIG. 3), and is constantly and resiliently urged toward a large inclination-angle position where the swash plate 9 has a large angle of inclination relative to a plane perpendicular to the rotating axis of the drive shaft 4. Namely, a control spring 14 is provided for applying a constant pressing force to the swash plate 9 at a position thereof distant from the pivoting axis thereof.

The swash plate 9 is also engaged with a linearly movable control cylinder 15 at a position thereof diametrically opposed to the above-mentioned position. Thus, when the control cylinder 15 is hydraulically moved forward and back by a pressurized oil supplied from the discharge bore **13*b* of the pump via a control circuit including an opening and closing valve 16, the swash plate 9 is pivoted about the pivoting axis thereof to increase or decrease the angle of inclination thereof with regard to the plane perpendicular to the axis of the drive shaft 4 against the constant pressing force of the control spring 14. Accordingly, in response to a change in the angle of inclination of the swash plate 9**, the theoretical displacement of the pump per revolution of the cylinder block is adjustably changed.

Nevertheless, the above-mentioned variable displacement pump encounters a defect in that since the control spring 14 is arranged so as to constantly urge the swash plate 9 to the large inclination-angle position thereof, when the operation of the pump is stopped, the swash plate 9 is always urged toward the largest inclination-angle position thereof by the spring 14. Namely, when the pump is stopped, the pressure level of the discharge oil of the pump is lowered due to leakage of pressurized oil through a clearance between the respective pistons 10 and the cylinder bores 7 of the cylinder block 6 as well as leakage of pressurized oil from the control cylinder 15 or from a return orifice of the control circuit of the control cylinder 15. Thus, the pressure of the pressurized oil supplied to the control cylinder 15 is insufficient for moving the swash plate 9 toward a small inclination-angle position thereof by overcoming the spring force of the control spring 14. Consequently, when the operation of the pump is started with the swash plate 9 urged toward the largest inclination-angle position, it is required to apply a large starting torque to the pump to start rotation of the drive shaft 4.

Further, since the displacement of the pump is controlled by changing the angle of inclination of the swash plate 9 by using the control cylinder 15 operated by a pressurized oil supplied from the pump per se, it is impossible to bring the angle of inclination of the swash plate 9 to a substantially zero position, because when the swash plate 9 is moved toward a zero inclination-angle position thereof by the control cylinder 15, the pressure level of the discharge oil of the pump is lowered, and accordingly the control cylinder 15 cannot exert a pressing force sufficient for maintaining the zero inclination-angle position of the swash plate 9 against the spring force of the control spring 14. As a result, the pump is unable to perform a continuous small displacement operation. Therefore, it is necessary to provide an appropriate clutch mechanism to disconnect the pump from a drive source such as an automobile engine when no load is applied to the pump.

In order to eliminate the above-mentioned defects of the pump illustrated in FIG. 3, the pending U.S. patent application Ser. No. 07/848,017, now issued as U.S. Pat. No. 5,207,751, corresponding to the pending Japanese Patent Application No. 3-45148 filed by the Applicant which is the same as the assignee company of the present application, discloses a different variable displacement piston pump. The pump is provided with a swash plate, a control spring capable of constantly urging the swash plate toward a small inclination-angle position, a control cylinder capable of pivotally moving the swash plate toward a large inclination-angle position against the spring force of the control spring, and an opening and closing valve arranged in an oil circuit for introducing pressurized oil into the control cylinder.

With the above-mentioned pump, since the swash plate is always urged toward the small inclination-angle position thereof by the control spring, when the operation of the pump is started, it is possible to gradually increase the displacement of the pump from the smallest displacement position close to a zero displacement position by controlling the operation of the control cylinder via the opening and closing valve. Namely, when the swash plate is eventually moved to the largest inclination-angle position against the spring force of the control spring, an ordinary operation of the pump at the largest displacement thereof is obtained. Thus, when no load is applied to the pump, the pump is able to maintain the smallest displacement operation close to a zero displacement operation. Namely, it is not necessary to provide any clutch mechanism between the pump and a pump drive source under no load conditions when the pump is incorporated in a hydraulic operation system for operating hydraulic devices of industrial vehicles. Nevertheless, when a clutch mechanism to disconnect the pump of the hydraulic operation system from the pump drive source is omitted, an unfavorable problem occurs in that, when powdery abraded material or other foreign materials are contained in the discharge oil circuit thereby causing plugging or clogging of the circuit or when a seizure occurs between the pistons and the cylinder bores, between the end face of the rotating cylinder block and the valve plate, and between the swash plate and the shoes due to a lack of lubrication, the drive shaft is driven compulsorily by the pump drive source, i.e., a vehicle engine under an abnormally large load (i.e., an excessive load) applied to the drive shaft.

SUMMARY OF THE INVENTION

An object of the present invention is therefore to obviate the problem encountered by the above-described variable displacement hydraulic piston pump according to the prior proposal.

Another object of the present invention is to provide a variable displacement hydraulic piston pump provided with a means enabling omission of a clutch mechanism between the pump and a pump drive source and also capable of preventing breakage of internal elements of the pump even when an abnormally large load is applied to the drive shaft of the pump during the operation of the pump.

In accordance with the present invention, there is provided a variable displacement hydraulic piston pump provided with a housing unit having an open-ended housing and an end covering closing one end of the housing, a drive shaft rotatably supported in the housing unit, an inclinable swash plate pivoted in the housing unit to assume a position between a predetermined small inclination-angle position thereof substantially parallel with a plane vertical to an axis of the drive shaft and a predetermined large inclination-angle position thereof inclining far from the plane, a cylinder block mounted on the drive shaft to be rotated about an axis thereof together with the drive shaft; the rotatable cylinder block being provided with a plurality of axial cylinder bores arranged parallel with the axis of the drive shaft, a plurality of axial pistons reciprocatorily fitted in the plurality of cylinder bores, respectively, and engaged with the swash plate via shoes, a valve plate arranged in close contact with an end of the rotatable cylinder block and having suction and discharge ports capable of being in cyclic communication with each of the plurality of cylinder bores; the suction and discharge ports being in constant communication with fluid suction and discharge bores formed in the end covering of the housing unit, respectively, a resilient unit arranged in the housing unit for constantly urging the swash plate toward the small inclination-angle position thereof, a hydraulic control cylinder unit arranged in the housing unit for providing the swash plate with a controlled force to move the swash plate to a desired position between the predetermined small and large angle positions thereof against the resilient unit, a hydraulic opening and closing control valve unit arranged in a hydraulic circuit of the hydraulic control cylinder unit for controlling the introduction of pressurized oil into the hydraulic control cylinder unit, an input shaft rotatably supported in the housing unit for transmitting a rotary drive power from an external drive source to the drive shaft, and a torque limiter unit arranged between the input shaft and the drive shaft for disconnecting the transmission of the rotary drive power from the input shaft to the drive shaft in response to a change in a load applied to the drive shaft.

Preferably, the pressurized oil introduced into the hydraulic control cylinder unit may be oil pressurized by and discharged from the pump per se.

Further preferably, the input shaft of the above-described variable displacement piston pump is directly connected to the rotary drive source without intervention of any clutch mechanism therebetween. Thus, when the pump is incorporated in a hydraulic actuating system of a certain hydraulic actuator mounted on a special-purpose vehicle such as a dump truck, a garbage truck, and a sanitation vehicle, a drive power of the vehicle engine is supplied to the input shaft of the pump, and is transmitted to the drive shaft of the pump via the torque limiter unit when an excessive load is not applied to the drive shaft of the pump.

When the hydraulic actuator of the special-purpose vehicle is not operated, i.e., when no load is applied to the pump, the hydraulic opening and closing control valve unit is shifted to a closing position thereof. Therefore, when the pump is driven by the vehicle engine, the position of the swash plate is urged by the resilient unit to take the smallest inclination-angle position thereof (i.e., 0.1 through 1.0 degree with respect to the plane perpendicular to the axis of the drive shaft) and exerting substantial zero displacement on the discharge line thereof. Accordingly, the operation of the pump is equivalent to a state where the pump is disconnected from the pump drive source by a clutch mechanism.

When a start command signal is input to start the pump, the opening and closing control valve unit is shifted to the opening position thereof, and the operation of the pump starts. Therefore, the swash plate set at the above-mentioned smallest angle of inclination causes the pistons to reciprocate in the cylinder bores to thereby discharge pressurized oil from the discharge bore of the pump toward the hydraulic control cylinder via the opened control valve unit. In response to advancement of the operation of the pump, the swash plate is gradually moved toward a larger inclination-angle position from the initial smallest inclination-angle position to thereby gradually increase the pump displacement. Namely, the operation of the pump starting from the smallest displacement operation thereof can be smoothly varied to a larger displacement operation until the constant largest displacement operation thereof is obtained.

When a stop command signal is input to stop the pump, the hydraulic control cylinder unit is shifted to the closing position thereof. Thus, the pressurized oil begins to leak from the clearances between the pistons and the cylinder bores of the pump and from a return orifice of the hydraulic control cylinder unit. As a result, the pressure level of the pressurized oil supplied to the hydraulic control cylinder unit is gradually lowered, and accordingly the hydraulic control cylinder unit becomes unable to exert a force urging the swash plate toward its large inclination-angle position against the resilient unit. Accordingly, the swash plate of the pump is pressed by the resilient unit to move toward a smaller inclination-angle position. Namely, the displacement of the pump is reduced from the large displacement to the smallest displacement substantially corresponding to the zero displacement.

During the operation of the pump at the constant largest displacement, when either plugging or clogging of the hydraulic discharge line of the pump or seizure of the rotatable cylinder block at the contacting portion between the cylinder block and the valve plate due to a lack of lubrication occurs, the torque limiter unit disconnects the input shaft from the drive shaft when a load applied to the drive shaft exceeds a predetermined value, i.e., a predetermined excessive load level, and accordingly, transmission of the rotary drive power from the input shaft to the drive shaft of the pump is stopped. Therefore, the drive shaft is not forcibly rotated, and accordingly, breakage of the internal elements and parts of the pump such as the discharge line and the slide contact portion of the cylinder block and the valve plate does not occur, and the pump can be recovered when the above-mentioned clogging and the lack of lubrication are remedied.

BRIEF DESCRIPTION OF THE DRAWINGS

The above and other objects, features and advantages of the present invention will be made apparent from the ensuing description of a preferred embodiment thereof in conjunction with the accompanying drawings wherein.

DESCRIPTION OF THE PREFERRED EMBODIMENT

Figure 1:
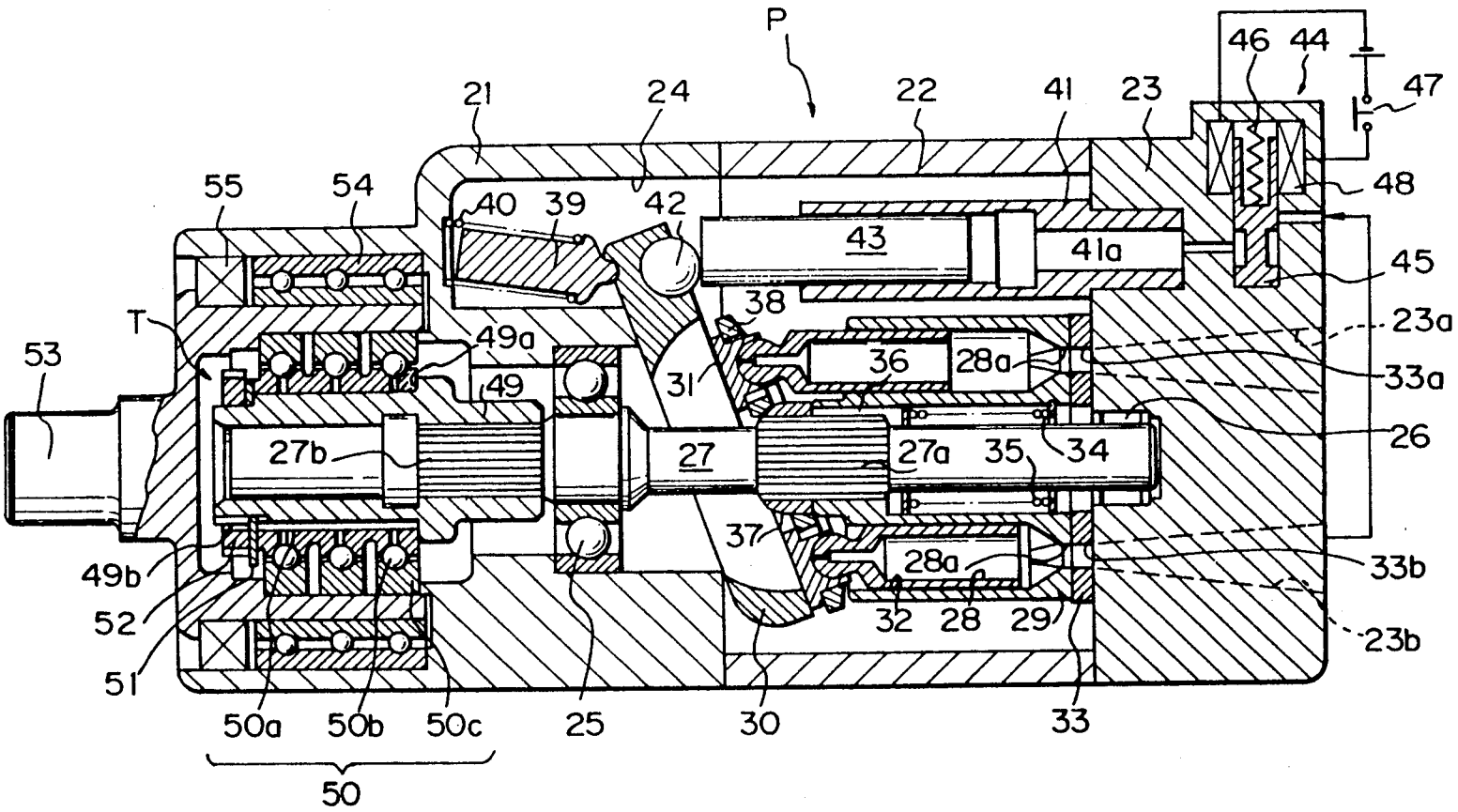
FIG. 1 is a longitudinal cross-sectional view of a variable displacement piston pump in accordance with an embodiment of the present invention.

Referring to FIG. 1, the variable displacement piston pump is provided with a housing assembly that includes a hollow front housing 21, a hollow intermediate housing 22 connected to a rear end of the front housing 21, and a cylindrical end covering 23 covering the end opening of the intermediate housing 22. The housing assembly defines a closed crank chamber 24 in which a drive shaft 27 is rotatably supported by a pair of anti-friction bearings 25 and 26 held by the front housing 21 and the end covering 23. The drive shaft 27 is provided at the rear end thereof with a splined portion 27*a* on which a cylinder block 29 is mounted so as to be axially slid. The cylinder block 29 is provided with a plurality of cylinder bores 28 arranged parallel with the axis of the drive shaft 27. A swash plate 30 arranged around the drive shaft 27 is pivotally supported by trunnion shafts (not shown in FIG. 1) so as to be inclined about a pivoting axis perpendicular to the axis of the drive shaft 27 from a small inclination-angle position substantially parallel with a plane perpendicular to the axis of the drive shaft 27. The swash plate 30 is operatively engaged with reciprocatory pistons 32 via shoes 31 rotatable and slidable with regard to the swash plate 27. The reciprocatory pistons 32 are slidably fitted in the plurality of cylinder bores 28, respectively. A valve plate 33 is arranged between the rear end of the cylinder block 29 and the end covering 23 so as to be in close contact with the rear end of the cylinder block 29, and accordingly, the cylinder bores 28 of the cylinder block 29 are sealed by the valve plate 33. The valve plate 33 is fixed to the end covering 23, and is provided with an arcuate suction port 33*a* circumferentially elongated along a locus along which an end opening of each cylinder bore 28 moves when the cylinder block 29 is rotated together with the drive shaft 27. The valve plate 33 is also provided with an arcuate discharge port 33*b* circumferentially elongated along the same locus. Thus, both arcuate suction and discharge ports 33*a* and 33*b* of the valve plate 33 are cyclically brought into communication with each of the cylinder bores 28 of the cylinder block 29 during the rotation of the cylinder block 29. The arcuate suction and discharge ports 33*a* and 33*b* are arranged so as to be in registration with suction and discharge bores 23*a* and 23*b*, respectively, formed in the end covering 23. Namely, the cylinder bores 28 of the cylinder block 29 are cyclically brought into communication with the suction and discharge bores 23*a* and 23*b* of the end covering 23.

A compression spring 35 is arranged in an annular space extending between the outer surface of the drive shaft 27 and the bore wall of the cylinder block 29 to be positioned between a pair of spacer members 34, 34. The spring force of the compression spring 35 is applied to a pivot 37 via the front spacer member 34 to press the pivot 37 in the direction corresponding to the axis of the drive shaft 27, and the pivot 37 is provided with a round surface thereof slidably engaged with retainers 38 rotatably holding therein the respective shoes 31. The spring force of the compression spring 35 also presses the cylinder block 29 via the rear spacer member 34 and a circular clip in a direction opposite to the direction in which the pivot 37 is pressed.

The swash plate 30 is engaged with a point end of a rod 39 at a marginal portion thereof operative to define a bottom dead center of the respective pistons 32, and a control spring 40 having one end received by an inner wall of the front housing 21 is arranged around the rod 39 so that the other end of the control spring 40 is engaged with a neck portion of the rod 39. Thus, the control spring 40 applies a spring force to the swash plate 30 via the point end of the rod 39 to thereby constantly urge the swash plate 30 toward the small inclination-angle position thereof.

A hydraulic control cylinder 41 is arranged inside the intermediate housing 22 so as to be in symmetry with the assembly of the rod 39 and the control spring 40 with respect to the above-mentioned bottom dead center defining portion of the swash plate 30. The hydraulic control cylinder 41 is provided with a control piston element 43 engaged with the swash plate 30 via a ball bearing 42. Namely, the control piston element 43 is advanced toward the swash plate 30 when pressurized oil is introduced into a pressure chamber 41*a* of the hydraulic control cylinder 41 via a hydraulic opening and closing valve 44 held by the end covering 23. The opening and closing valve 44 is fluidly connected to the discharge bore 23*b* of the end covering 23 via an appropriate oil conduit, and is provided with an axially movable valve spool element 45 having an annular recess through which the pressurized oil discharged from the discharge bore 23*b* of the pump is introduced into the pressure chamber 41*a*. The valve spool element 45 is constantly urged by a spring 46 toward a first position, i.e., a closing position where a cylindrical land portion of the valve spool element 45 interrupts a fluid communication between the discharge bore 23*b* of the pump and the pressure chamber 41*a* as illustrated in FIG. 1. Nevertheless, the valve spool element 45 is axially moved from the above-mentioned first position to a second position, i.e., an opening position where the annular recess of the valve spool element 45 provides a fluid communication between the discharge bore 23*b* of the pump and the pressure chamber 41*a* when a solenoid 48 arranged around one end of the valve spool element 45 is electrically energized in response to an ON signal given by an appropriate command signal generating means.

The pump is provided with a torque limiter T housed in the front housing 21. Namely, the drive shaft 27 includes a front spline portion 27*b* with which is engaged a boss element 49 having an annular flange 49*a* extending around the axially middle portion of the outer surface thereof and an outer screw-threaded portion 49*b* formed at the frontmost portion thereof. A torque adjustable bearing 50 is arranged around the above-mentioned boss element 49 so as to include an inner race member 50*a*, a plurality of ball bearings 50*b* and an outer race member 50*c*. The inner race member 50*a* mounted on the boss element 49 has one end abutted against the annular flange 49*a* of the boss 49, a plurality of ball receipts, and annular slits opening toward the plurality of ball receipts. The inner race member 50*a* is axially tightened, via a washer element 51, by a nut element 52 threadedly engaged with the screw-threaded portion 49*b* of the boss 49. The outer race member 50*c* of the torque adjustable bearing 50 is received in the cylindrical bore of the input shaft 53 that is rotatably supported by the frontmost portion of the front housing 21 via a bearing 54. A sealing element 55 is arranged between the input shaft 53 and the front housing 21 to seal the bearing 54 against the exterior of the pump.

Figure 2:
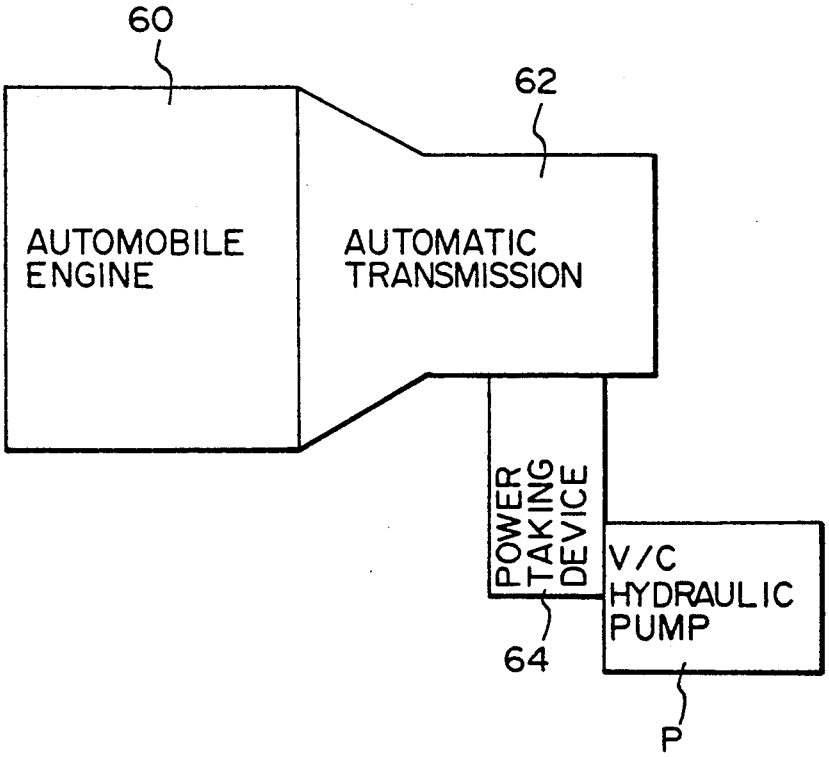
FIG. 2 is a diagrammatic explanatory view illustrating a pump driving system wherein the pump according to the present invention is mounted on an industrial vehicle having an automobile engine capable of being used for driving the pump.
Figure 3:
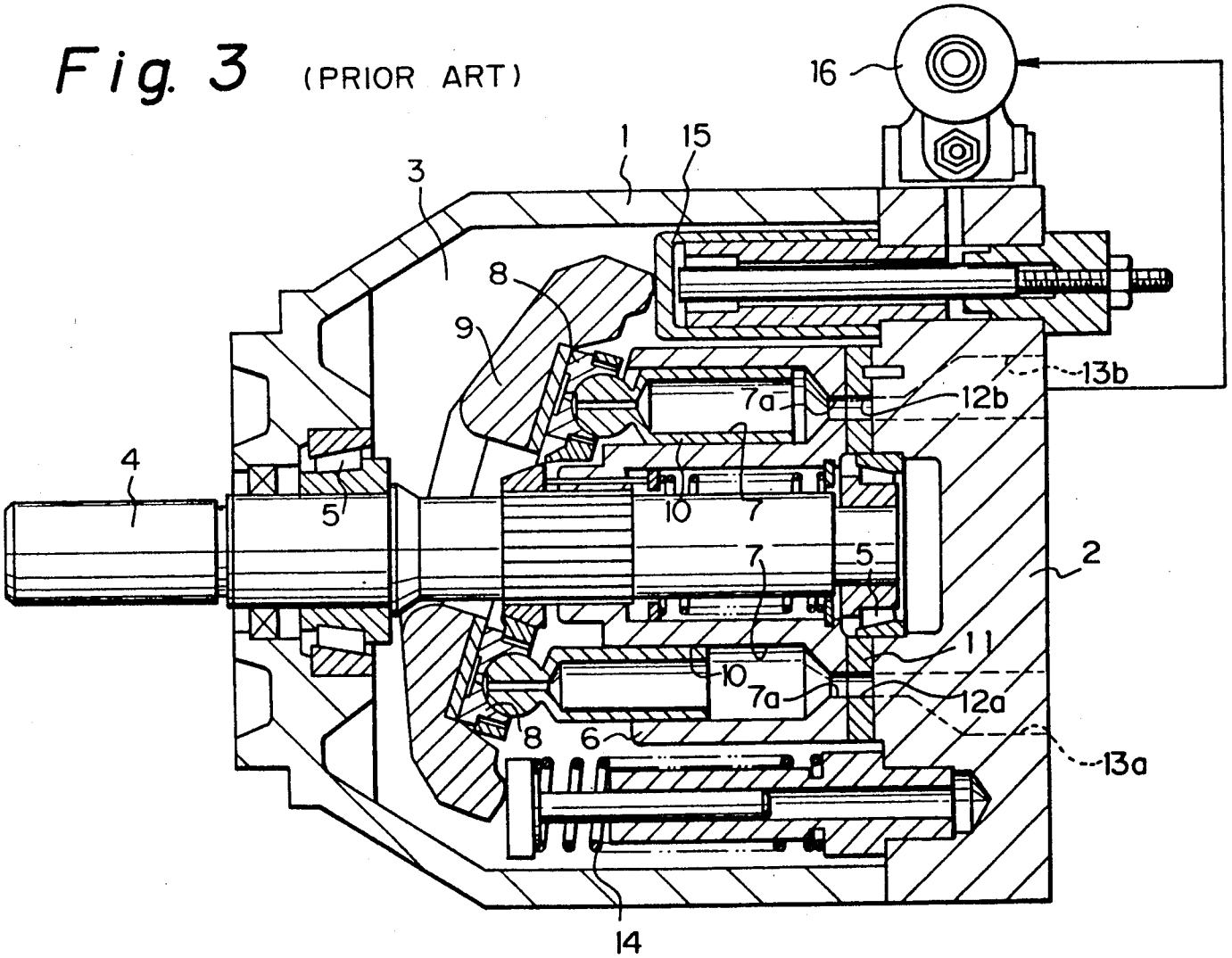
Fig. 3 (PRIOR ART)
FIG. 3 is a longitudinal cross-sectional view of a variable displacement piston pump in accordance with the prior art.

As shown in FIG. 2, the variable displacement hydraulic piston pump P described in conjunction with FIG. 1 may be mounted on, for example, a vehicle in such a manner that the input shaft 53 of the pump P is directly connected to a power taking device 64 attached to an automatic transmission 62 of an automobile engine 60. When the pump P is used for e.g., driving a refrigerant compressor of an air-conditioning system of the vehicle, the discharge bore 23*b* of the pump P is connected to a hydraulic motor, an output shaft of which is connected to the refrigerant compressor of the air-conditioning system.

At this stage, it is to be noted that the power taking device 64 is constantly placed in operation, and that a command signal input unit 47 (FIG. 1) for controlling the operation of the opening and closing valve 44 is constituted by e.g., an air-conditioner switch of the vehicle. When an ordinary load less than the predetermined excessive load level is applied to the drive shaft 27 of the pump P, the torque limiter T arranged between the input shaft 53 driven by the automobile engine 60 via the power taking device 64 and the drive shaft 27 allows transmission of the rotary drive power from the input shaft 53 to the drive shaft 27. Namely, the pump P is driven by the automobile engine 60.

When the air-conditioning system is stopped, i.e., when the command signal input unit 47 is OFF, the valve spool element 45 of the opening and closing valve 44 is shifted by the control spring 46 to the closing position thereof, and accordingly the pressure chamber 41*a* of the hydraulic control cylinder 41 cannot be supplied with any pressurized oil. Thus, the swash plate 30 is urged by the spring 40 toward the smallest inclination-angle position (i.e., approximately 1.0 degree from the plane perpendicular to the axis of the drive shaft 27) and exhibits substantially zero displacement. Namely, it is possible to consider the pump P being disconnected from the engine 60 by a clutch mechanism. Thus, since the pump P does not deliver pressurized discharge oil (working oil for the hydraulic motor) therefrom toward the hydraulic motor, the refrigerant compressor is not operated by the hydraulic motor, and accordingly the air-conditioning system is stopped.

When the air-conditioning system is operated, the command signal input unit 47 is turned ON to energize the solenoid 48 of the opening and closing valve 44 thereby moving the valve spool element 45 toward the opening position thereof. Therefore, the pressure chamber 41*a* of the hydraulic control cylinder 41 is supplied with pressurized oil from the discharge bore 23*b* of the pump P via the opened opening and closing valve 44. The pressure level of the pressurized oil is initially in approximate proportion to the smallest angle of inclination of the swash plate 30. However, during continuation of the operation of the pump P at the smallest inclination-angle of the swash plate 30, the pressure level of the discharge oil of the pump P is gradually raised by the reciprocation of the respective pistons 32. Therefore, the pressure chamber 41*a* of the hydraulic control cylinder 41 is supplied with the pressure raised oil so that the piston element 43 is advanced to gradually increase the angle of inclination of the swash plate 30. Namely, the operation of the pump P is smoothly varied from the smallest displacement operation to a larger displacement operation until the constant largest displacement operation of the pump P is obtained.

During the air-conditioning of the vehicle, when the air-conditioning system is turned OFF, i.e., when the command signal input unit 47 is shifted from ON to OFF, the opening and closing valve 47 is shifted from the opening position to the closing position thereof. Thus, the pressure level of the discharge oil of the pump P is lowered due to leaking of the pressurized oil from the clearance of the respective cylinder bores and the other sliding portions of the cylinder block 29 as well as a delivering of the pressurized oil from the hydraulic control cylinder unit 41 through an oil return-orifice of the cylinder unit 41. Accordingly, the pressure level in the pressure chamber 41*a* of the hydraulic control cylinder 41 is gradually lowered to thereby reduce a pressing force of the piston element 43 of the control cylinder unit 41. Thus, the swash plate 30 is moved by the resilient force of the spring 40 toward the smallest inclination-angle position. Consequently, the operation of the pump P varies to the smallest displacement operation even though the rotation of the drive shaft 27 continues.

When the discharge line of the pump P is clogged by abraded powdery materials or other foreign materials during the constant large displacement operation of the pump P or when a seizure occurs between the pistons 32 and the cylinder bores 28, between the end face of the rotatable cylinder block 29 and the valve plate 33, or between the shoes 31 and the swash plate 30 due to lack of lubrication, an excessive load is applied to the drive shaft 27. Thus, the ball bearings 50*b* of the torque adjustable bearing 50 begin to roll between the inner race member 50*a* and the outer race member 50*c* by overcoming a restraining force exhibited by both inner and outer race members 50*a* and 50*c*. Namely, the torque limiter T functions to disconnect the drive shaft 27 from the input shaft 53, and the transmission of the rotary drive force of the automobile engine 60 to the drive shaft 27 is stopped. Accordingly, the drive shaft 27 is not forcibly rotated and accordingly the internal elements and parts of the pump P, i.e., the discharge line of the pump P and the various sliding elements of the pump P are not damaged and broken.

In the above-described embodiment, the variable displacement hydraulic pump P is used for driving the refrigerant compressor of the air-conditioning system of a vehicle. However, many applications of the pump P occur. For example, when the pump P is mounted on a special-purpose vehicle, i.e., a dump truck to deliver pressurized oil to a hydraulic loading system of the dump truck, the command signal input unit 47 is constituted by a loading control switch operating in association with the operation of a control lever operated by a truck driver. The input shaft 53 of the pump is directly connected to the engine of the dump truck via the power taking device 64 similar to that shown in FIG. 2.

When an ordinary load is applied to the drive shaft 27 of the pump P, the torque limiter T does not disconnect the drive shaft 27 from the input shaft 53, and accordingly, the drive shaft 27 is continuously rotated by the engine of the dump truck. Thus, when the loading switch is turned ON, the pump P starts to deliver the discharge oil toward the loading system. When the loading control switch is turned OFF, the pump P with the drive shaft 27 rotated by the truck engine smoothly varies its operation from the ordinary largest displacement operation to the zero displacement operation delivering no pressurized oil.

When an excessive load is applied to the drive shaft 27, the drive shaft 27 is disconnected from the input shaft 53 by the torque limiter T, and accordingly transmission of the rotary drive power from the engine of the dump truck to the drive shaft 27 is stopped. Thus, an idle rotation of the input shaft 53 continues until the excessive load to the drive shaft 27 is removed.

From the foregoing description, it will be understood that since the variable displacement hydraulic pump according to the present invention is able to operate at a substantially zero displacement, it is possible to omit an arrangement of a clutch mechanism between the pump and the pump drive source such as an automobile engine. Thus, the pump of the present invention can be directly and constantly connected to the pump drive source so as to simplify the mounting of the pump on various vehicles such as industrial vehicles.

Further, the variable displacement hydraulic pump according to the present invention can protect the internal elements and parts from breakage and damage even if an excessive load is applied to the drive shaft of the pump, and accordingly, safety of the pump is improved.

It should be understood that many modifications and variations of the present invention will occur to persons skilled in the art without departing from the scope and spirit of the invention as claimed in the appended claims. For example, it is possible to shift the pivoting axis of the swash plate about which the swash plate is pivoted to vary the angle of inclination thereof from an arrangement wherein the pivoting axis is perpendicular to the axis of the drive shaft to another arrangement wherein the pivoting axis of the swash plate is located at a position close to a portion of the swash plate defining the top dead center of the respective pistons. Then, the reaction force due to the pumping of the fluid by the respective pistons acts on the swash plate so as to increase the angle of inclination of the swash plate. Therefore, the operation of the pump can quickly vary from the smallest displacement operation to a larger displacement operation. Consequently, it is possible to set the smallest inclination-angle of the swash plate at an extremely small angle.

We claim:

1. A variable displacement hydraulic piston pump comprising:

a housing means having an open-ended housing and an end covering closing one end of the housing;

a drive shaft rotatably supported in said housing means;

an inclinable swash plate pivoted in said housing means to take a position between a predetermined small inclination-angle position thereof substantially parallel with a plane vertical to an axis of said drive shaft and a predetermined large inclination-angle position thereof inclining far from the plane;

a cylinder block mounted on said drive shaft to be rotated about an axis thereof together with said drive shaft; the rotatable cylinder block being provided with a plurality of axial cylinder bores arranged parallel with the axis of said drive shaft;

a plurality of axial pistons reciprocatorily fitted in the plurality of cylinder bores, respectively, and engaged with said inclinable swash plate via shoes;

a valve plate arranged in close contact with an end of said rotatable cylinder block and having suction and discharge ports capable of being in cyclic communication with each of the plurality of cylinder bores; the suction and discharge ports being in constant communication with fluid suction and discharge bores formed in said end covering of said housing means, respectively;

a resilient means arranged in said housing means for constantly urging said swash plate toward the small inclination-angle position thereof;

a hydraulic control cylinder means arranged in said housing means for providing said swash plate with a controlled force to move said swash plate to a desired position between the predetermined small and large angle positions thereof against said resilient means;

a hydraulic opening and closing control valve means arranged in a hydraulic circuit of said hydraulic control cylinder means for controlling the introduction of pressurized oil into said hydraulic control cylinder means;

an input shaft rotatably supported in said housing means for transmitting a rotary drive power from an external drive source to said drive shaft; and a torque limiter means arranged between said input shaft and said drive shaft for disconnecting the transmission of the rotary drive power from said input shaft to said drive shaft in response to an overload encountered by said drive shaft.

2. A variable displacement hydraulic piston pump according to claim 1, wherein said resilient means comprises a spring member arranged in such a manner that one end thereof is fixed to said open-ended housing of said housing means and the other end thereof is operatively engaged with a portion of said swash plate defining the bottom dead center of each of said plurality of reciprocatory pistons during rotating of said cylinder block.

3. A variable displacement hydraulic piston pump according to claim 2, wherein said resilient means further comprises a rod member around which said spring in the shape of a coil is wound; said rod member having a ball point end at the frontmost thereof engaged with said portion of said swash plate, and a neck portion thereof against which said other end of said spring is seated.

4. A variable displacement hydraulic piston pump according to claim 2, wherein said hydraulic control cylinder means comprises an axially advancing piston element having an outer end thereof engaged with said portion of said swash plate; said axially advancing piston element being hydraulically advanced to press said portion of said swash plate toward said predetermined large inclination-angle position against said spring of said resilient means.

5. A variable displacement hydraulic piston pump according to claim 4, wherein said hydraulic control cylinder means further comprises a pressure chamber into which the pressurized oil is introduced to advance said piston element.

6. A variable displacement hydraulic piston pump according to claim 1, wherein said hydraulic opening and closing valve means comprises a linearly movable valve spool element, and a solenoid arranged around said valve spool element; said valve spool element being constantly and resiliently urged toward a closing position thereof preventing the pressurized oil from being introduced into said hydraulic control cylinder means, and moved from said closing position thereof toward an opening position thereof permitting the pressurized oil to be introduced into said hydraulic control cylinder means upon energizing of said solenoid.

7. A variable displacement hydraulic piston pump according to claim 6, wherein said solenoid of said hydraulic opening and closing valve means comprises a command signal input circuit means for controlling the energizing of said solenoid.

8. A variable displacement hydraulic piston pump according to claim 1, wherein said input shaft is provided with an externally extending portion thereof extending beyond a frontmost end of said housing means and capable of being directly connected to said external drive source, and a hollow cylindrical portion rotatably held by said open-ended housing of said housing means via a bearing element.

9. A variable displacement hydraulic piston pump according to claim 1, wherein said torque limiter means comprises a torque adjustable bearing means including an outer race member engaged with said input shaft, an inner race member engaged with said drive shaft and provided with torque adjusting slits formed therein, and a plurality of ball bearings arranged between said outer and inner race members; said plurality of ball bearings being permitted to roll between said outer and inner race members when said load applied to said drive shaft exceeds a predetermined extent.

10. A variable displacement hydraulic piston pump according to claim 1, wherein said hydraulic circuit of said hydraulic control cylinder means comprises an oil conduit means branched from a discharge bore of said pump toward said hydraulic opening and closing valve means for supplying the pressurized oil delivered from said pump to said hydraulic control cylinder means.

11. A variable displacement hydraulic piston pump according to claim 1, wherein said pump is mounted on an engine-operated vehicle provided with an engine and a power taking device by which a rotary drive power is taken out, and wherein said external drive source comprises said engine of said vehicle; said power taking device being directly connected to said input shaft.

* * * * *